United States Patent [19]

James

[11] Patent Number: 4,866,343

[45] Date of Patent: Sep. 12, 1989

[54] RE-ENTRANT DOUBLE-STAGGERED LADDER CIRCUIT

[75] Inventor: Bertram G. James, Redwood City, Calif.

[73] Assignee: Varian Associates, Inc., Palo Alto, Calif.

[21] Appl. No.: 260,154

[22] Filed: Oct. 20, 1988

[51] Int. Cl.[4] ..... H01J 25/36

[52] U.S. Cl. ..... 315/3.5; 315/3.6; 315/39.3

[58] Field of Search ..... 315/3.5, 3.6, 39.3

[56] References Cited

U.S. PATENT DOCUMENTS 4,237,402 12/1980 Karp ..... 315/3.5
4,409,518 10/1983 Karp et al. ..... 315/39.3
4,409,519 10/1983 Karp ..... 315/3.5
4,586,009 4/1986 James ..... 315/3.5

*Primary Examiner*—Donald J. Yusko
*Assistant Examiner*—Brian S. Palladino
*Attorney, Agent, or Firm*—Stanley Z. Cole; Gerald M. Fisher; Peter J. Sgarbossa

[57] ABSTRACT

A slow-wave circuit for a TWT has periodic transverse plates extending across the axial by extending vacuum envelope. An opposed pair of apertures 24, 26 in each plate 20 couple adjacent cavities 28 between plates 20. Coupling apertures 24 in alternate plates 20 are rotated transverse to apertures 26 in the other plates to provide coupling only between adjacent cavities 28. Each plate 20 has transverse ridges 30 enclosing its axial beam aperture 22. The ridges 30 are orthogonal to the coupling apertures 24, 26 to increase beam coupling and decrease capacitance for wider bandwidth and higher impedance.

8 Claims, 1 Drawing Sheet

RE-ENTRANT DOUBLE-STAGGERED LADDER CIRCUIT

FIELD OF THE INVENTION

The invention pertains to slow wave interaction circuits for traveling wave tubes, particularly for millimeter wavelengths and high power. The pertinent class has been called "ladder" circuits because they are derived from a circuit in which the periodic interaction elements are like the rungs of a ladder extending across a hollow tube.

PRIOR ART

The simple ladder circuit mentioned above has very little bandwidth because the coupling between periodic elements is small. Subsequent improvements included capacitive loading of the rungs by proximity to a ramp extending from the envelope toward their central portions. This gave the circuit a backward-wave fundamental characteristic which required interaction with a space-harmonic of the circuit wave. A different improvement was inductive loading by making the central parts of the rungs wider than the legs, giving a forward-wave interaction.

The closest prior art to the present invention includes the "comb-quad" circuit disclosed in U.S. Pat. No. 4,237,402 issued Dec. 2, 1980 to Arthur Karp. This has two ladders orthogonal to each other with their rungs interleaved. The resulting double coupling gives increased bandwidth. There are, however, construction difficulties in aligning the parts and the heat removal is basically one-dimensional along the rungs. Further prior art pertaining to this patent is discussed therein.

U.S. Pat. No. 4,409,519 issued Oct. 11, 1983 to Arthur Karp discloses a structure with wide rungs providing two-dimensional heat removal and coupling apertures staggered on alternating opposite sides of the rungs so that each cavity is coupled only to its immediate neighbors, which gives increased usable bandwidth.

U.S. Pat. No. 4,586,009 issued Apr. 29, 1986 to Bertram G. James dislcoses a "double staggered" circuit having two coupling apertures between adjacent cavities alternating between two orthogonal axial planes. The double coupling increases the bandwidth, but this is still limited by the low intrinsic impedance (R/Q) of the cavities between the rungs.

These cited patents are all assigned to the assignee of the present invention.

SUMMARY OF THE INVENTION

The object of the invention is to provide travelling wave tube of increased interaction impedance and bandwidth, high power output and economical manufacture.

This object is achieved by a slow-wave ladder circuit, with orthogonal, interleaved rungs and double-staggered coupling apertures. Raised ridges across the rungs transverse to their extent surround the beam apertures to provide close spacing for improved beam interaction and low capacitive loading for increased bandwidth.

DESCRIPTION OF THE PREFERRED EMBODIMENTS

Figure 1:
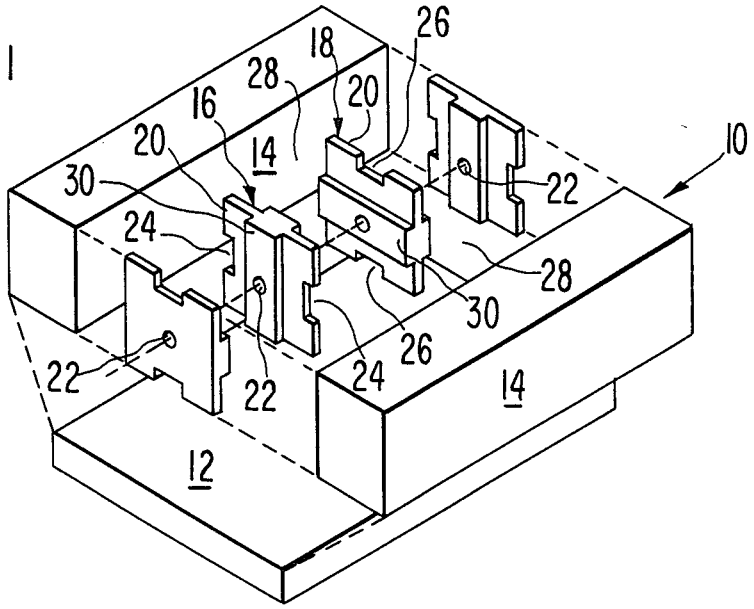
FIG.1 is an exploded isometric sketch of the circuit parts before final assembly.

FIG. 1 shows the essential structure of the invention. The slow-wave circuit comprises a hollow extended metallic envelope 10, preferably of round or square cross-section, shown here as comprising a flat bottom plate 12, a pair of side plates 14 and a top cover plate (not shown). Alternate constructions may be used, such as forming three of the sides from a grooved block. Inside envelope 10 are two interleaved sets of "rungs" 16,18, spaced periodically along the axis. Each rung 16, 18 comprises a flat plate 20 which substantially closes off the envelope passageway when the exploded parts in FIG. 1 are brought together. At the center of each rung 16, 18 is an aperture 22 aligned on-axis for passage of the electron beam. Each rung 16, 18 has a pair of coupling apertures 24, 26 on opposite sides of plate 20, increasing the intercavity coupling and hence, the bandwidth above that obtainable with single apertures. Coupling apertures 24 in the first set of rungs 16 are right angles to apertures 26 in the second set 18 so that the cavities 28 between rungs 16, 18 are coupled only to their immediate neighbors. This improves the shape of the bandpass characteristic.

Each rung 16, 18 has a pair of parallel ridges 30 on its faces, surrounding beam apertures 22 and extending across rungs 16, 18 at right angles to the direction from beam aperture 22 to coupling apertures 24, 26. The function of ridges 30 is to increase the interaction impedance and hence, efficiency and bandwidth of the travelling wave tube. For good efficiency the gaps between successive beam apertures 22 must be kept short so that electrons across it in a fraction of an rf cycle before the electric field changes substantially. Since this is a backward-wave circuit, each electron should be in the shielded interior of an aperture hole 22 while the field is reversing, so that the electron is exposed to fields in the same phase as it crosses successive gaps. In addition, the electric fields are concentrated in the region of the beam by the action of the parallel ridges 30, thereby also increasing the interaction impedance. The interaction impedance improvement per se could be achieved by simply making the rungs thicker, but this would decrease the "cold" bandwidth and not concentrate the electric fields in the region of the electron beam. The "hot" bandwidth depends on, first, the degree of coupling between adjoining circuit elements (essentially resonant cavities) and, secondly, the characteristic impedance of the individual cavity elements between rungs, often referred to as R/Q. In the lumped-circuit analogy, R is the interaction impedance at resonance and Q is the ratio of rf energy stored to energy extracted per radian. Putting the rung surfaces closer together increases their mutual capacitance and hence the energy stored for a given interaction voltage between them.

The ridges 30 on rungs 16, 18 shorten the interaction gaps as described above. Since opposed ridges 30 cross each other transversely, the area of short gaps is much less than if the entire rungs were thicker, so the capacitance is decreased and bandwidth is increased. In low-frequency tubes with easily machinable parts, this result is sometimes produced by apertured conical noses projecting from the cavity walls. In the dimensions required for millimeter waves, these would be prohibitively hard to manufacture and assemble, so the ridges offer a reasonable solution.

Rungs 16, 18 preferably have a square overall outline. They are then identical in shape, simplifying manufacture. Final assembly involves aligning them with alternating rotations and brazing to the surrounding envelope bottom 12, side 14 and top (not shown) plates.

Figure 2:
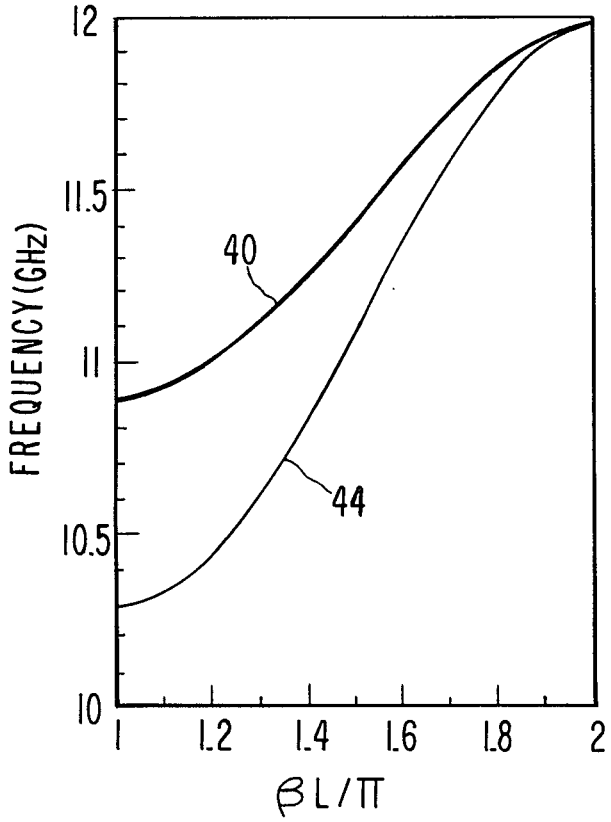
FIG. 2 is a graph of the dispersion characteristics of double-staggered circuits with and without re-entrancy.

FIG. 2 illustrates the advancement in TWT bandwidth achieved by the invention. It is a graph of the dispersion diagram of slow-wave circuits in which frequency (ordinate) is plotted against $\beta L/\pi$ (abscissa) which is the phase change in half-cycles per periodic length of the circuit.

The upper curve 40 is from data on a prior-art, non-reentrant, double-staggered ladder circuit as described in aforementioned U.S. Pat. No. 4,409,519. The rungs of that invention are flat slabs. The total "cold" bandwidth between bandedge cutoff frequencies is 1.05 GHz or 9.4% of the center frequency.

Lower curve 44 is data from the re-entrant, double-staggered ladder circuit of the present invention. The total bandwidth is 1.65 GHz or 14.2% of the center frequency, an increase of 50% in percentage bandwidth.

The usable operating bandwidths are those portions over which the dispersion curves are substantially linear so that the circuit wave can be synchronous with a fixed electron velocity. These are quite proportional to the total "cold" bandwidths listed above.

The preferred embodiment described above is exemplary and not limiting. Other embodiments within the scope of the invention will be obvious to those skilled in the art. The invention is to be limited only by the following claims and their legal equivalents.

I claim:

1. A slow-wave circuit for a travelling-wave tube comprising:

a hollow, enclosed conductive channel extending along a central axis, a periodic array of conductive cross members transverse to said channel and connected to opposite walls of said channel, said cross members having beam apertures aligned on said axis for passage of a beam of charged particles, a first set of said cross members having axially aligned first coupling apertures near a first side of said channel and axially raised first ridges extending across corresponding faces of said cross members transverse to the orientation of said coupling apertures about said axis and enclosing said beam apertures, a second set of said cross members interleaved with said first set along said axis having coupling apertures and ridges respectively transverse to those of said first set.

2. The circuit of claim 1 further comprising in each of said cross members a second coupling aperture opposite said first coupling aperture from said axis.

3. The circuit of claim 1 further comprising on each of said cross members a second ridge parallel to said first ridge on the opposite face of said cross member.

4. The circuit of claim 2 further comprising on each of said cross members a second ridge parallel to said first ridge on the opposite side of said cross member.

5. The circuit of claim 1 wherein said coupling apertures are formed by grooves in said cross members covered by joining said cross members to said walls of said channel.

6. The circuit of claim 5 wherein the periphery of said cross members except said grooves is joined to said walls.

7. The circuit of claim 6 wherein said periphery is square.

8. The circuit of claim 6 wherein said periphery is circular.

* * * * *